US005478410A

United States Patent [19]

Ushigami et al.

[11] Patent Number: 5,478,410

[45] Date of Patent: Dec. 26, 1995

[54] PROCESS FOR PRODUCING GRAIN-ORIENTED ELECTRICAL STEEL SHEET HAVING LOW WATT LOSS

[75] Inventors: Yoshiyuki Ushigami; Yozo Suga; Takeo Nagashima, all of Kitakyushu, Japan

[73] Assignee: Nippon Steel Corporation, Tokyo, Japan

[21] Appl. No.: 405,422

[22] Filed: Mar. 15, 1995

Related U.S. Application Data

[63] Continuation of Ser. No. 150,338, Nov. 10, 1993, abandoned, which is a continuation of Ser. No. 815,340, Dec. 27, 1991, abandoned.

[30] Foreign Application Priority Data

Jan. 4, 1991 [JP] Japan ..... 3-000023

[51] Int. Cl.[6] ..... C21D 8/12

[52] U.S. Cl. ..... 148/111; 148/112; 148/113

[58] Field of Search ..... 148/111, 112, 148/113

[56] References Cited

U.S. PATENT DOCUMENTS

| | | | |
|---|---|---|---|
| 3,632,456 | 1/1972 | Sakakura et al. | 148/111 |
| 3,785,882 | 1/1974 | Jackson | 148/113 |
| 4,537,792 | 8/1985 | Kitayama et al. | 148/113 |
| 4,655,854 | 4/1987 | Nishiike et al. | 148/113 |
| 4,692,193 | 9/1987 | Yoshitami et al. | 148/111 |
| 4,994,120 | 2/1991 | Takahashi et al. | 148/111 |

FOREIGN PATENT DOCUMENTS

| | | | |
|---|---|---|---|
| 0219611 | 4/1987 | European Pat. Off. . | |
| 50-99915 | 9/1979 | Japan | 148/113 |
| 54-120215 | 9/1979 | Japan | 148/113 |

OTHER PUBLICATIONS

Patent Abstracts of Japan, vol. 7, No. 155, (C–175) Apr. 22, 1983 JP–A–58–067871.

Patent Abstracts of Japan, vol. 9, No. 283, (C–313) Nov. 9, 1985 JP–A–60–128213.

Patent Abstracts of Japan, vol. 8, No. 168 (C 236) Aug. 3 1984 JP–A–59–067 372.

Patent Abstracts of Japan, vol. 3, No. 128, (C–062) Oct. 24, 1979 JP–A–54–106009.

Patent Abstracts of Japan, vol. 14, No. 539 (C–782) Nov. 28, 1990 JP–A–22–28481.

Patent Abstracts of Japan, vol. 11, No. 268 (C–444) Aug. 29, 1987 JP–A–62–070525.

European Search Report EP 91 31 1850 mailed May 4, 1993.

*Primary Examiner*—Scott Kastler
*Assistant Examiner*—Sikyin Ip
*Attorney, Agent, or Firm*—Kenyon & Kenyon

[57] ABSTRACT

A process for producing a grain-oriented electrical steel sheet having a low watt loss, in which a steel strip consisting, in wt %, of 0.8 to 4.8 Si, 0.012 to 0.050 acid-soluble Al, 0.01 or less N, and the balance consisting of Fe and unavoidable impurities is cold-rolled to a final thickness of 0.15 mm or less, primary-recrystallization annealed, applied with a annealing separator containing magnesia as a major component by electrostatic spray painting, and then final-texture annealed.

1 Claim, 2 Drawing Sheets

PROCESS FOR PRODUCING GRAIN-ORIENTED ELECTRICAL STEEL SHEET HAVING LOW WATT LOSS

This application is a continuation of application Serial No. 08/150,338 filed Nov. 10, 1993, now abandoned, which is a continuation of application Ser. No. 07/815,340 filed Dec. 27, 1991, now abandoned.

BACKGROUND OF THE INVENTION

1. Field of the Invention

The present invention relates to a process for producing a grain-oriented electrical steel sheet having a texture or a grain orientation of {110}<001> or {100}<001> in terms of the Miller's index.

The grain-oriented electrical steel sheet is used as a soft magnetic material for an iron core of electrical equipment and transformers, etc.

2. Description of the Related Art

The basic magnetic concept of the grain-oriented electrical steel sheet originated in the discovery of a magnetic anisotropy of an iron single crystal in 1926 (K. Honda and S. Kaya: Sci. Reps. Tohoku Imp. Univ. 15, (1926). page 721). N. P. Goss later invented a process of producing a steel sheet having a {110}<001>-oriented structure, and thereafter, the magnetic property of the grain-oriented electrical steel sheet has been remarkably improved.

This accumulated specific orientation of the grain-oriented steel sheet is achieved by utilizing a phenomenon known as a "secondary recrystallization".

The control of the secondary recrystallization essentially requires an adjustment of a primary recrystallization prior to the secondary recrystallization, and further, an adjustment of the fine precipitates known as "inhibitor" or grain boundary-precipitating elements. The inhibitor serves to suppress the growth of grains among primary-recrystallized grains other than those which form secondary-recrystallized grains, and thus allows a preferential growth of the secondary-recrystallized grains.

The current processes of manufacturing a grain-oriented electrical steel sheet can be classified into three types.

The first type was proposed by M. F. Littmann in Japanese Examined Patent Publication (Kokoku) No. 30-3651, in which MnS serves as an inhibitor and cold rolling is carried out in two stages; the second type was proposed by Taguchi and Sakakura in Japanese Examined Patent Publication (Kokoku) No. 40-15644, in which AlN and MnS serve as inhibitors and a final cold rolling is carried out at a severe draft of more than 80%; and the third type was proposed by Imanaka et al. in Japanese Examined Patent Publication (Kokoku) No. 51-13469, in which MnS (or MnSe) and Sb serve as inhibitors and the cold rolling is carried out in two stages.

These processes provide commercially available grain-oriented electrical steel sheets having an extremely highly accumulated grain orientation providing a magnetic flux density of about 1.92 Tesla.

Recent rises in energy costs, however, make it necessary for electric instrument manufacturers to save energy, and accordingly, the demand for a low watt loss material has become greater.

It is known that, although a reduced sheet thickness lowers the watt loss of a grain-oriented electrical steel sheet, it also causes the secondary recrystallization to become unstable, and thereby impairs the degree of accumulation of the grain orientation.

Current commercially available grain-oriented electrical steel sheets have a thickness of about 0.20 mm, and there is a strong demand for a process by which a thinner grain-oriented electrical steel sheet can be stably produced.

SUMMARY OF THE INVENTION

The object of the present invention is to provide a process for producing a grain-oriented electrical steel sheet having a thickness of 0.15 mm or less, and thus having an improved or reduced watt loss, from a silicon steel slab containing Al, by clarifying the factors leading to an occurrence of an unstable secondary recrystallization, to thereby optimize the process conditions that ensure a stable secondary recrystallization.

To achieve the above object according to the present invention, there is provided a process for producing a grain-oriented electrical steel sheet having a low watt loss, comprising the steps of:

preparing a steel strip consisting, in wt %, of 0.8 to 4.8 Si, 0.012 to 0.050 acid-soluble Al, 0.01 or less N, and the balance consisting of Fe and unavoidable impurities;

cold rolling the steel trip to a final thickness of 0.15 mm or less by a single stage, or by two or more stages with an intermediate annealing between the stages;

primary-recrystallization annealing the cold rolled strip;

applying an annealing separator containing magnesia as a main component to the strip by electro-static spray painting; and final-texture annealing the strip.

Preferably, the final-texture annealing is carried out by maintaining a nitrogen partial pressure of 25% or more until a secondary recrystallization of the strip is completed.

DESCRIPTION OF THE PREFERRED EMBODIMENTS

The present inventors made a detailed study of the secondary recrystallization behavior of materials having different thicknesses, and found that a reduced sheet thickness causes an unstable secondary recrystallization because the amount of inhibitors in the steel sheet is rapidly reduced during a final-texture annealing, and further, found that the water content of a magnesia applied to the sheet surface as an annealing separator in the form of a slurry plays an important role in the control of the above-mentioned speed of the reduction of the inhibitor amount.

The present inventors found that the speed of the reduction of the inhibitor amount is significantly varied in accordance with the sheet thickness.

For example, a hot-rolled strip of a silicon steel, having a chemical composition, in weight, of 3.3% Si, 0.027% acid-soluble Al, 0.008% N, 0.14% Mn, 0.007% S, 0.05% C, and the balance of Fe and unavoidable impurities, was annealed at 1100° C. for 2 min and then cold-rolled to form 0.30 mm and 0.15 mm thick steel sheets. The steel sheets were annealed at 830° C. for 2 min in a wet hydrogen atmosphere, to simultaneously effect a decarburization and cause a primary recrystallization of the steel sheets. The sheets were nitrided in an ammonia atmosphere, to stabilize the later secondary recrystallization and ensure that the total nitrogen content of the sheets became 170 ppm, to thereby strengthen the inhibitors. Anannealing separator mainly composed of magnesia in the form of a slurry was then applied thereto, and thereafter, the steel sheets were final-texture annealed in a gas atmosphere of 25% $N_2$ plus 75% $H_2$.

Figure 1:
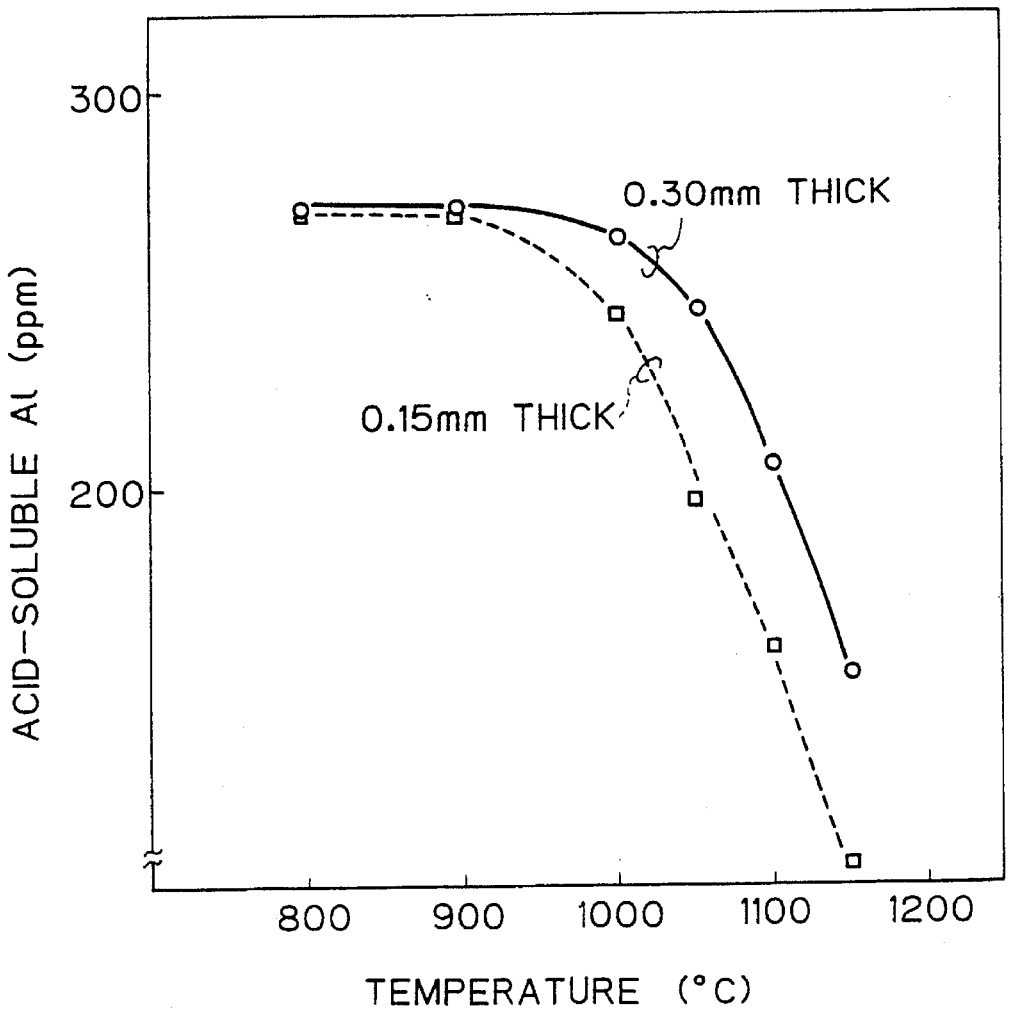
FIG. 1 is a graph showing variations of the behavior of inhibitors in terms of the amount of acid-soluble Al during a final-texture annealing process.

Samples were taken from the sheets during the final-texture annealing process, to determine the variations in the behavior of inhibitors such as AlN and (Al, Si)N, etc. FIG. 1 shows the results, and it can be seen that the inhibitor content was reduced more rapidly in the thinner sheet than in the thicker sheet.

Accordingly, it is considered that the secondary recrystallization is unstable in a thinner material because the undesired growth of unintended primary-recrystallized grains cannot be effectively suppressed during the annealing period necessary for a complete growth of desired secondary-recrystallized grains.

The present inventors made a detailed study of the rate-determining process of the reduction of the inhibitor amount, and found that the dominant factor is an oxidation of Al atthe steel sheet surface.

Figure 2:
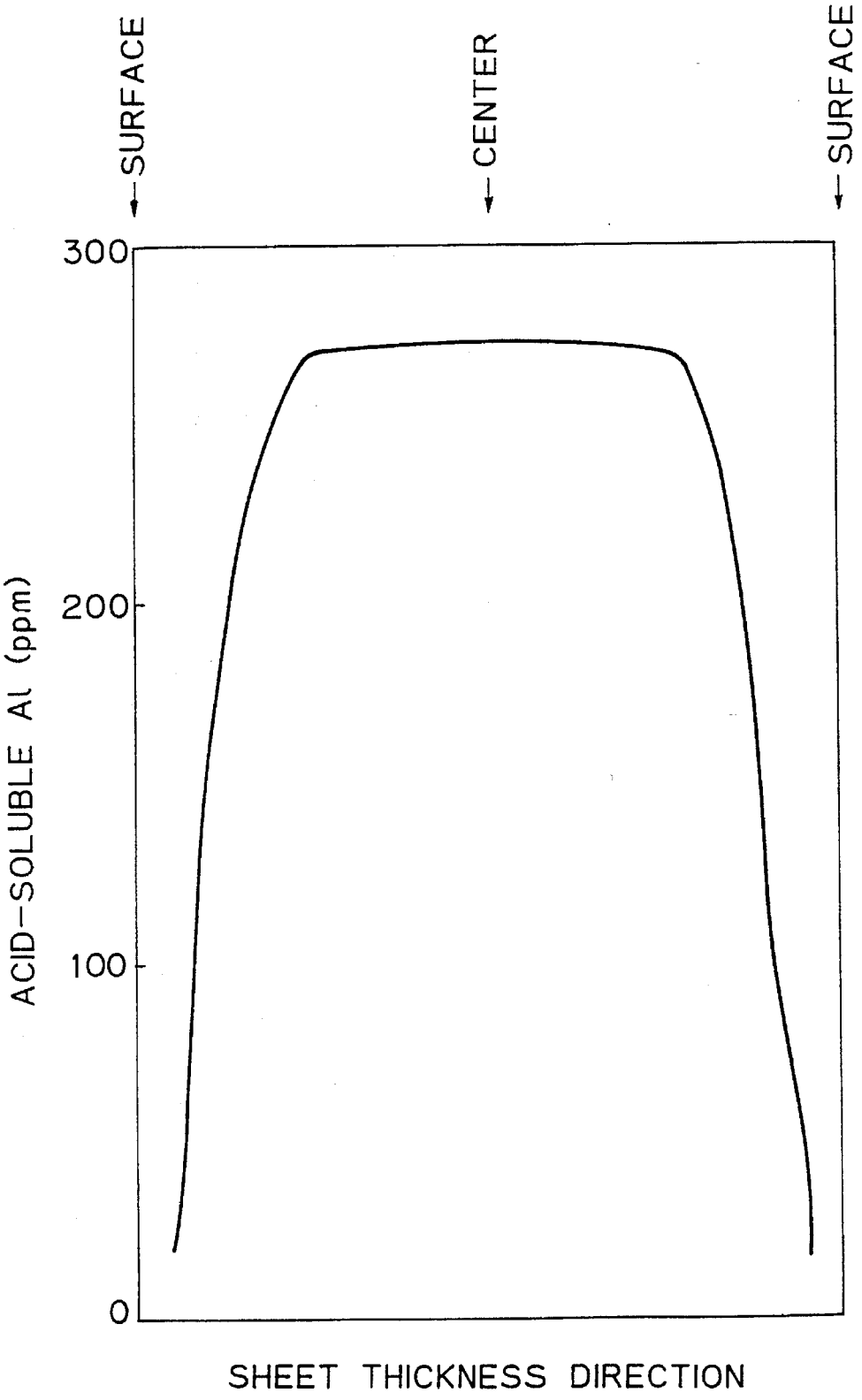
FIG. 2 is a graph showing a distribution of inhibitors in terms of the amount of acid-soluble Al over the steel sheet thickness when the secondary recrystallization is manifested at a temperature of 1050° C.

FIG. 2 shows the distribution of inhibitors in terms of the amount of acid-soluble Al over the steel sheet thickness when the secondary recrystallization was manifested at a temperature of 1050° C., and it can be seen that the inhibitor amount is reduced near the steel sheet surface. This is believed to be because, during the final-texture annealing, the magnesia applied to the steel sheet surface in the form of a slurry containing hydrated water raises the oxygen potential of the annealing atmosphere in the vicinity of the steel sheet surface, to thus cause the Al in the steel to react with the oxygen and thereby consume the Al in the sub-surface layer of a steel sheet.

In a thinner sheet, it is believed that this oxidation reaction has an influence not only in the steel sheet surface but also in the whole thickness of the sheet, with the result that the inhibitor amount is reduced more rapidly in the thinner sheet than in a thicker sheet.

Accordingly, the oxygen potential of the annealing atmosphere in the vicinity of the steel sheet surface should be maintained at a low level, to thereby ensure a stable secondary recrystallization of a thinner material, and the inventors found that an annealing separator mainly composed of magnesia should be applied to the steel sheet surface by electrostatic spray painting, not as a slurry.

The electrostatic spray painting of magnesia disclosed by Japanese Examined Patent Publication (Kokoku) No. 60-17026, considers only the economical effect, as can be seen from the description therein, "Although many patents have been issued regarding the prevention of burning or sticking and the glassy coating for a high-temperature annealing of a grain-oriented electrical steel sheet, the present invention provides a great industrial advantage in that an electrostatic spray painting type process can be operated continuously for a long time by the use of an extremely inexpensive, unhydrated dead-burnt magnesia instead of the conventional expensive, calcined magnesia".

Thus, it was not known that an electrostatic spray painting of a magnesia-based annealing separator had an influence on inhibitors such as AlN and (Al, Si)N, etc., as first found by the present inventors.

When a final-texture annealing is carried out under a reduced oxygen potential according to the present invention, the nitrogen potential has a strong influence on the stability of inhibitors such as AlN and (Al, Si)N, etc., particularly during the final-texture annealing, and therefore, the nitrogen potential is preferably 25% or more, more preferably 50% or more.

The steel strip used for the present invention essentially consists of 0.8–4.8 wt % Si, 0.012–0.050 wt % acid-soluble Al, 0.01 wt % or less N, and the balance of Fe and unavoidable impurities. Other elements need not be limited.

The inclusion of Si is essential for a raising of the electric resistance and reduction of the watt loss, but when the Si content is more than 4.8 wt %, the strip is easily cracked during the cold rolling, and thus the cold rolling impossible. Also, when the Si content is too small, an α-to-γ transformation occurs during a final-texture annealing, whereby the desired crystal orientation of texture is lost, and therefore, the lower limit of the Si content is 0.08 wt %, which does not have an adverse effect on the crystal orientation.

The acid-soluble Al is an essential element which is bonded with N to thereby form inhibitors such as AlN and (Al, Si)N. The amount of acid-soluble Al is limited to from 0.012 to 0.050 wt %, to thus ensure a high magnetic flux density.

N must be present in steel in an amount sufficient to provide an inhibitor in the form of AlN and (Al, Si)N, but the N content must not be more than 0.01 wt % as this will lead to the formation of blisters or cavities in a steel sheet.

The present inventive steel strip may further contain Mn, S, Se, B, Bi, Nb, Sn, Ti or other inhibitor forming elements.

A molten steel having the above-specified composition is cast as an ingot and hot-rolled to form a strip, or is continuously cast to form a continuous-cast strip.

The hot-rolled strip or continuous-cast strip is cold-rolled directly or after a short time annealing.

This short time annealing is effected at a temperature of from 750° C. to 1200° C. for a time of from 30 sec to 30 min, to improve the magnetic flux density of the final product sheet, and therefore, may or may not be used in accordance with the magnetic property required and the production cost.

When a unidirectional grain orientation is desired, cold rolling is carried out at a final cold rolling reduction of 80% or more, as disclosed in Japanese Examined Patent Publication (Kokoku) No. 40-15644, and for a bidirectional grain orientation, cold rolling is carried out by a cross-rolling process at a cold rolling reduction of from 40 to 80%, as disclosed in Japanese Examined Patent Publication (Kokoku) Nos. 35-2657 and 38-8218.

The cold-rolled strip is primary-recrystallization annealed at a temperature of from 750° to 900° C., and if necessary, in a wet hydrogen atmosphere to remove the C usually contained in steel.

According to the present invention, an annealing separator containing magnesia as a major component is then applied to the steel strip by an electrostatic spray painting process.

The final-texture annealing is preferably carried out in an atmosphere having a nitrogen partial pressure of 25% or more, until the secondary recrystallization is completed, as herein previously described.

EXAMPLE 1

A hot-rolled steel strip consisting of 3.2 wt % Si, 0.030 wt % acid-soluble Al, 0.008 wt % N, 0.14 wt % Mn, 0.007 wt % S, 0.05% wt % C, and the balance of Fe and unavoidable impurities was annealed by a two-step process at 1120° C. for 2 min and at 900° C. for 2 min, and then cold-rolled to a thickness of 0.15 mm.

To cause a primary recrystallation of the cold-rolled strip, the strip was annealed at 830° C. for 1 min, in a wet hydrogen atmosphere, to effect a simultaneous decarburization.

An annealing separator containing magnesia as a major component was applied to the strip, either in the form a slurry as used in the conventional process (A), or by electrostatic spray painting according to the present invention (B).

The final-texture annealing was carried out by heating the strip to 1200° C. in an atmosphere of 25% $N_2$ plus 75% $H_2$, and the atmosphere was then changed to 100% $H_2$ to effect a purification annealing for 10 hours.

A phosphoric acid-based tension coating solution was applied to the strip and a laser beam irradiation was used to subdivide the magnetic domains.

Table 1 shows the magnetic properties of thus-obtained product sheets.

TABLE 1

| Application of annealing separator | Magnetic flux density (B8 in Tesla) | Watt loss (W17/50 in W/kg) |
|---|---|---|
| (A) Conventional | 1.51 (secondary recrystallization incomplete) | >1.5 |
| (B) Invention | 1.91 | 0.65 |

EXAMPLE 2

Primary-recrystallized strips obtained under the same process conditions as in Example 1 were applied with an annealing separator containing magnesia as a major component, by electrostatic spray painting.

The final-texture annealing was carried out by heating to 1200° C. in different atmospheres having different nitrogen partial pressures ranging from 0 to 100%. After the temperature reached 1200° C., the atmosphere was changed to 100% $H_2$, and a purification annealing was effected therein at 1200° C. for 10 hours.

Table 2 summarizes the nitrogen partial pressure of the final-texture annealing atmosphere, the magnetic flux density, and the percent secondary recrystallization.

TABLE 2

| Nitrogen partial pressure during final-texture annealing (%) | Magnetic flux density (B8 in Tesla) | Percent secondary recrystallization |
|---|---|---|
| 0 | 1.52 | 0 |
| 10 | 1.65 | 30 |
| 25 | 1.90 | 95 |
| 50 | 1.92 | 100 |
| 75 | 1.91 | 100 |
| 100 | 1.90 | 100 |

As described above, the present invention provides a process for producing a thin grain-oriented electrical steel sheet having a thickness of 0.15 mm or less and superior magnetic properties, particularly a low watt loss and a high magnetic flux density, by stabilizing the secondary recrystallization.

We claim:

1. A process for producing a grain-oriented electrical steel strip having a low watt loss of about 0.65 W/kg at $W_{17/50}$, consisting of the steps of:

providing a steel strip consisting of, in wt %, 0.8 to 4.8 Si, 0.012 to 0.050 acid-soluble Al, 0.01 or less N, effective amount Mn and S to act as an inhibitor and the balance being Fe and unavoidable impurities;

then cold rolling said steel strip to a final thickness of 0.15 mm or less by a single stage or by two or more stages with an intermediate annealing between said stages, thereby providing a cold rolled strip having a surface;

the primary-recrystallization annealing said cold rolled strip, said primary-recrystallization annealing simultaneously causing decarburization;

then applying an annealing separator containing unhydrated magnesia as a major component directly on said strip surface by electrostatic spray painting; and then final-texture annealing said strip; and during said final texture annealing, maintaining a nitrogen partial pressure of 25% or more until secondary recrystallization of said strip is completed, said final texture annealing step including purification annealing; and, then after final texture annealing, applying a tension coating solution to the strip.

* * * * *

UNITED STATES PATENT AND TRADEMARK OFFICE

CERTIFICATE OF CORRECTION

PATENT NO. : 5,478,410

DATED : December 26, 1995

INVENTOR(S) : Yoshiyuki USHIGAMI, et al.

It is certified that error appears in the above-indentified patent and that said Letters Patent is hereby corrected as shown below:

Column 2, line 29, change "electro-static" to --electrostatic--.

Column 3, line 26, change "atthe" to --at the--.

Column 3, line 54, change "economical" to --economic--.

Column 4, line 17, before "impossible" insert --is--.

Column 6, line 35, change "the" at beginning of line to --then--.

Signed and Sealed this

Sixteenth Day of July, 1996

Bruce Lehman

*Attest:*

BRUCE LEHMAN

*Attesting Officer*

*Commissioner of Patents and Trademarks*